US007255580B2

(12) United States Patent
Foltz et al.

(10) Patent No.: US 7,255,580 B2
(45) Date of Patent: Aug. 14, 2007

(54) ELECTRICAL CONNECTOR AND ELECTRICAL CONNECTOR ASSEMBLY HAVING LEVER ASSIST WITH LATCH HOLD DOWN MECHANISM

(75) Inventors: Keith R Foltz, Duncannon, PA (US); Bradley S Buchter, East Berlin, PA (US); John R Shuey, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 12 days.

(21) Appl. No.: 11/075,596

(22) Filed: Mar. 9, 2005

(65) Prior Publication Data

US 2006/0205254 A1 Sep. 14, 2006

(51) Int. Cl.
*H01R 13/62* (2006.01)

(52) U.S. Cl. ..... 439/157

(58) Field of Classification Search ..... 439/152–157, 439/310, 372

See application file for complete search history.

(56) References Cited

U.S. PATENT DOCUMENTS 4,682,836 A 7/1987 Noorily et al.
4,711,507 A 12/1987 Noorily
4,711,511 A 12/1987 Noorily
5,401,179 A * 3/1995 Shinchi et al. ..... 439/157
5,474,461 A * 12/1995 Saito et al. ..... 439/157
5,595,492 A * 1/1997 Taguchi ..... 439/157
5,695,349 A * 12/1997 Taguchi et al. ..... 439/157
5,833,484 A 11/1998 Post et al.
6,558,176 B1 * 5/2003 Martin et al. ..... 439/157
2006/0205254 A1 * 9/2006 Foltz et al. ..... 439/157
2006/0205262 A1 * 9/2006 Buchter et al. ..... 439/358

FOREIGN PATENT DOCUMENTS

EP 1 592 092 A 11/2005

* cited by examiner

*Primary Examiner*—James R. Harvey

(57) ABSTRACT

A connection system is shown where a lever-assist member may be added to assist in the mating between two connector housings as is needed depending upon a number of connector terminals loaded and the mating force between them. The lever-assist member is also locked in place by the interaction of the pivot-assist member and the corresponding latching structure of the connectors. The lever-assist member, when moved into the disconnection condition, has a projection which holds the cantilever beam arm of the latch in a position allowing the two connectors to be disconnected, which does not require the user to continue depressing the latch at the same time as rotating the pivot-assist member.

30 Claims, 15 Drawing Sheets

ELECTRICAL CONNECTOR AND ELECTRICAL CONNECTOR ASSEMBLY HAVING LEVER ASSIST WITH LATCH HOLD DOWN MECHANISM

BACKGROUND OF THE INVENTION

The subject invention relates to a connector design having a mating assist member to assist in the mating and unmating of two hand mate capable electrical connector halves.

In several different applications or industries, particularly in the automotive industry, electrical connector designs are standardized on various different harnesses or on various different discrete ends of a particular harness.

Just by way of example, it is common to provide as part of a wiring harness, wiring which extends into the automobile body, for example, and be connected to a mating connector at or under the driver's seat. Such connections can be used for the power seat having multiple ways of adjustment including up, back, tilt, and lumbar, as well as providing the opportunity for multiple variances of seat heating. In such an example, it would be common to provide multiple sizes of terminals depending on the power or amperage that needs to run through the cable, and thus the connectors need to accommodate multiple sizes of terminals as well.

It is also common in the industry to have standardized maximum mating forces which are allowable for the assembly line in automobile plants. One such standard, known as USCAR, has designated 75 Newtons as a maximum mating force. USCAR is an umbrella organization made up of automotive manufacturers for joint research. This is the maximum force that can be designed into a connector assembly, where the two connectors are mated into a latched condition by hand including no assistance in the connection. Above the 75-Newton requirement, some type of mating assistance between the two connectors is required.

It is well known in the industry to provide for a mating assist member, sometimes in the form of a pivotal lever, for example, as shown in U.S. Pat. No. 5,833,484 incorporated herein by reference. The lever can rotate to cause cooperable teeth on the mating housings to engage and bring the housings together. It is also a requirement to have a latching structure which can retain the two housings together. This can cause difficulties where a latch must be disengaged while at the same time, a lever needs to be rotated, as two hands are normally required, and the two functions may conflict with each other ergonomically.

The object then of the present invention is to provide a connector design which can accommodate all of the above-mentioned requirements.

SUMMARY OF THE INVENTION

The objects were accomplished by providing an electrical connector, for interconnection to a mate able connector, where the mate able connector has a latch, to latch the electrical connector and the mate able connector together. The electrical connector comprises a connector housing having a mating assist member for assisting in the drawing together of the connector housing and the mate able connector, the mating assist member having a contoured surface to cooperate with, and hold down the latch, during the counter rotation of the mating assist member.

The mating assist member may be comprised of a lever, which may also be profiled as a pinion gear with gear teeth which mesh with teeth on the mate able connector.

The mating assist member may also be locked to the latch, when in the fully latched position. The mating assist member may be comprised of a lever member which rotates into a snap locked position with the latch, when in a fully latched position. The lever member may be comprised of an upper lever arm and two side arms, which pivot relative to the housing. The electrical connector may have a trailing edge of the upper lever arm profiled to snap lock beneath the latch of the mate able electrical connector.

The electrical connector may have the contoured surface comprised as a projection, profiled to engage the latch upon movement of the mating assist member. The latch may be profiled as a cantilevered beam extending rearwardly of the housing. The extreme end of the cantilevered beam may be a contact surface. The mating assist member may be comprised of a lever which rotates into a snapped lock position with the contact surface, when in the fully latched position.

In another version of the invention, an electrical connector assembly comprises a first connector housing for interconnection to a mate able second connector housing, where one of the connector housings has a latch, to latch the first connector housing and the mate able second connector together, and the other of the connector housings has a mating assist member for assisting in the drawing together of the connector housings. The mating assist member has a contoured surface to cooperate with, and hold down the latch, during the counter rotation of the mating assist member.

The mating assist member may be comprised of a lever and the lever may be profiled as a pinion gear with gear teeth which mesh with teeth on the mate able connector. The mating assist member may be locked to the latch, when in a fully latched position. The mating assist member may be comprised of a lever which rotates into a snapped lock position with the latch, when in the fully latched position. The lever may be comprised of an upper lever arm and two side arms, which pivot relative to the housing. The trailing edge of the upper lever arm may be profiled to snap lock beneath the latch of the mate able electrical connector.

The contoured surface may be comprised of a projection, profiled to engage the latch upon movement of the mating assist member. The latch may be profiled as a cantilevered beam extending rearwardly of the housing. The extreme end of the cantilevered beam is a contact surface. The mating assist member is comprised of a lever which rotates into a snap locked position with the contact surface, when in the fully latched position In yet another aspect of the invention, an electrical connector assembly comprises a first connector housing for interconnection to a mate able second connector housing. One of the connector housings has a latch to latch the first connector housing and the mate able second connector together. The other of the connector housings has a mating assist member for assisting in the drawing together of the connector housings, the mating assist being locked to the latch, when in a fully latched position.

The latch may be profiled as a cantilevered beam extending rearwardly of the housing. The extreme end of the cantilevered beam may be a contact surface. The mating assist member may be comprised of a lever which rotates into a snapped lock position with the contact surface, when in the fully latched position. The lever may be comprised of an upper lever arm and two side arms, which pivot relative to the housing. The trailing edge of the upper lever arm may be profiled to snap lock beneath the latch of the mate able electrical connector.

The mating assist member may also have a contoured surface to cooperate with, and hold down the latch, during the counter rotation of the mating assist member. The contoured surface may be comprised of a projection, profiled to engage the latch upon movement of the mating assist member.

DESCRIPTION OF THE PREFERRED EMBODIMENT

Figure 1:
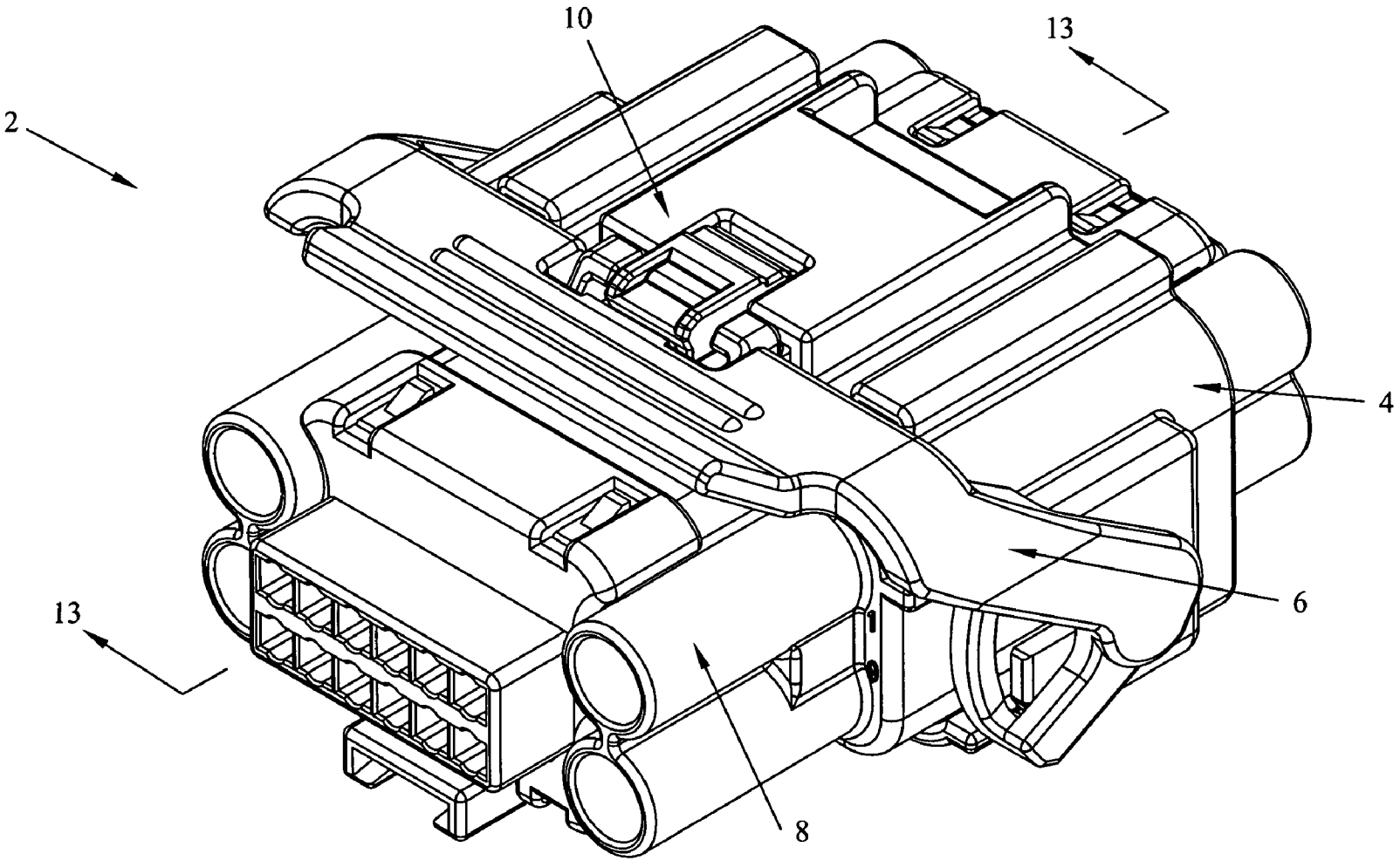
FIG. 1 is a perspective view showing the connector assembly in a mated condition.
Figure 2:
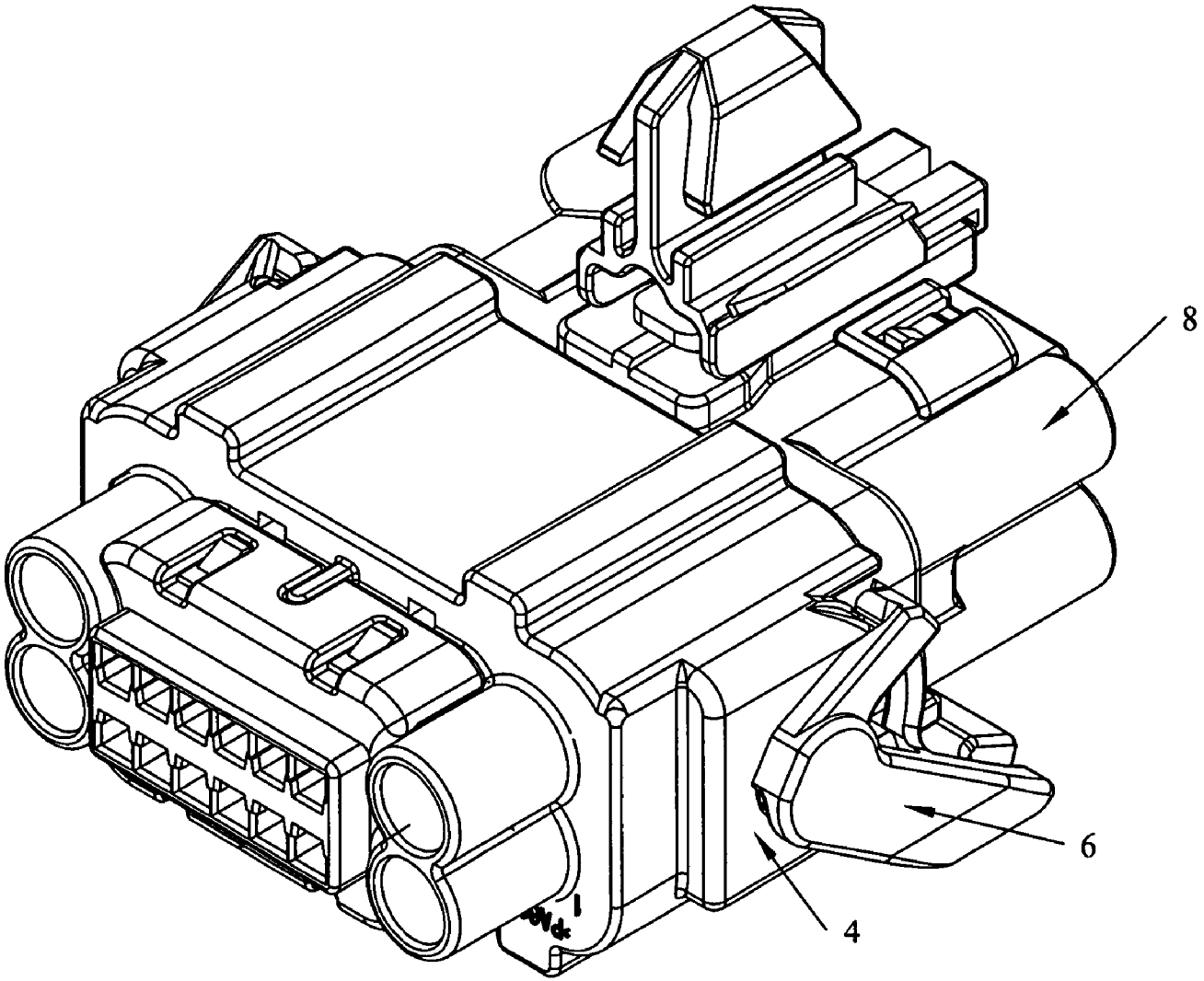
FIG. 2 is an underside perspective view of FIG. 1.

With respect first to FIGS. 1 and 2, an electrical connector assembly is shown as 2, which comprises a plug connector assembly 4 with a mating assist member 6, shown here as a lever or lever arm, interconnected to a header connector assembly shown at 8. The two connector assemblies 4, 8 are held together by a latch assembly shown generally at 10 and which will be described in greater detail herein.

Figure 3:
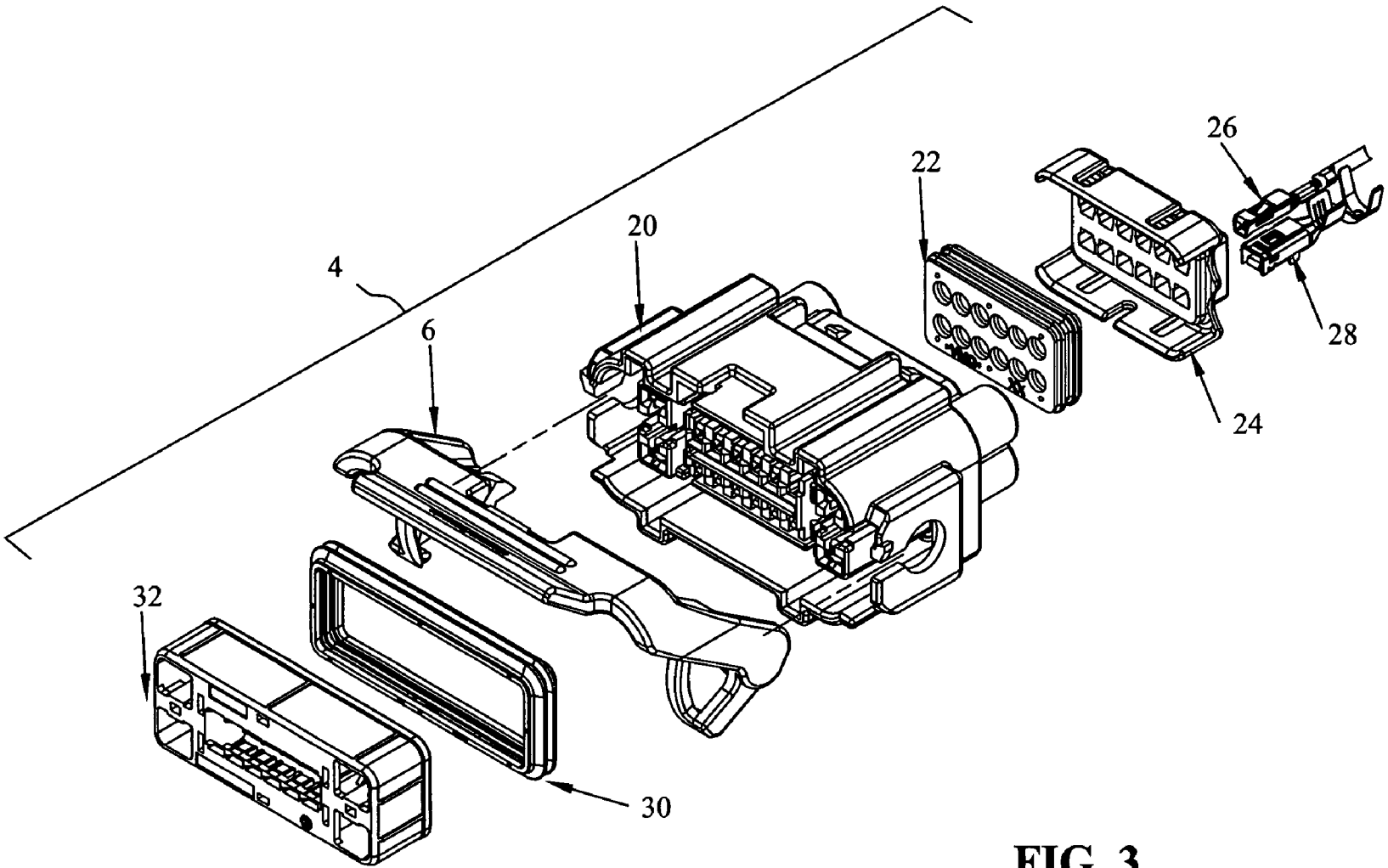
FIG. 3 shows an exploded view of the entire plug assembly of the embodiment of FIG. 1.

With respect now to FIG. 3, the plug or female connector assembly 4 is shown in an exploded manner, where mating assist member 6 is exploded away from its associated connector housing 20, and where a rear wire seal 22 and rear cover 24 are also shown together with contacts or terminals 26 and 28. On the front side of the connector housing 20, a front seal 30 and a terminal position assurance member 32 are shown exploded from the front side of connector housing 20.

Figure 4:
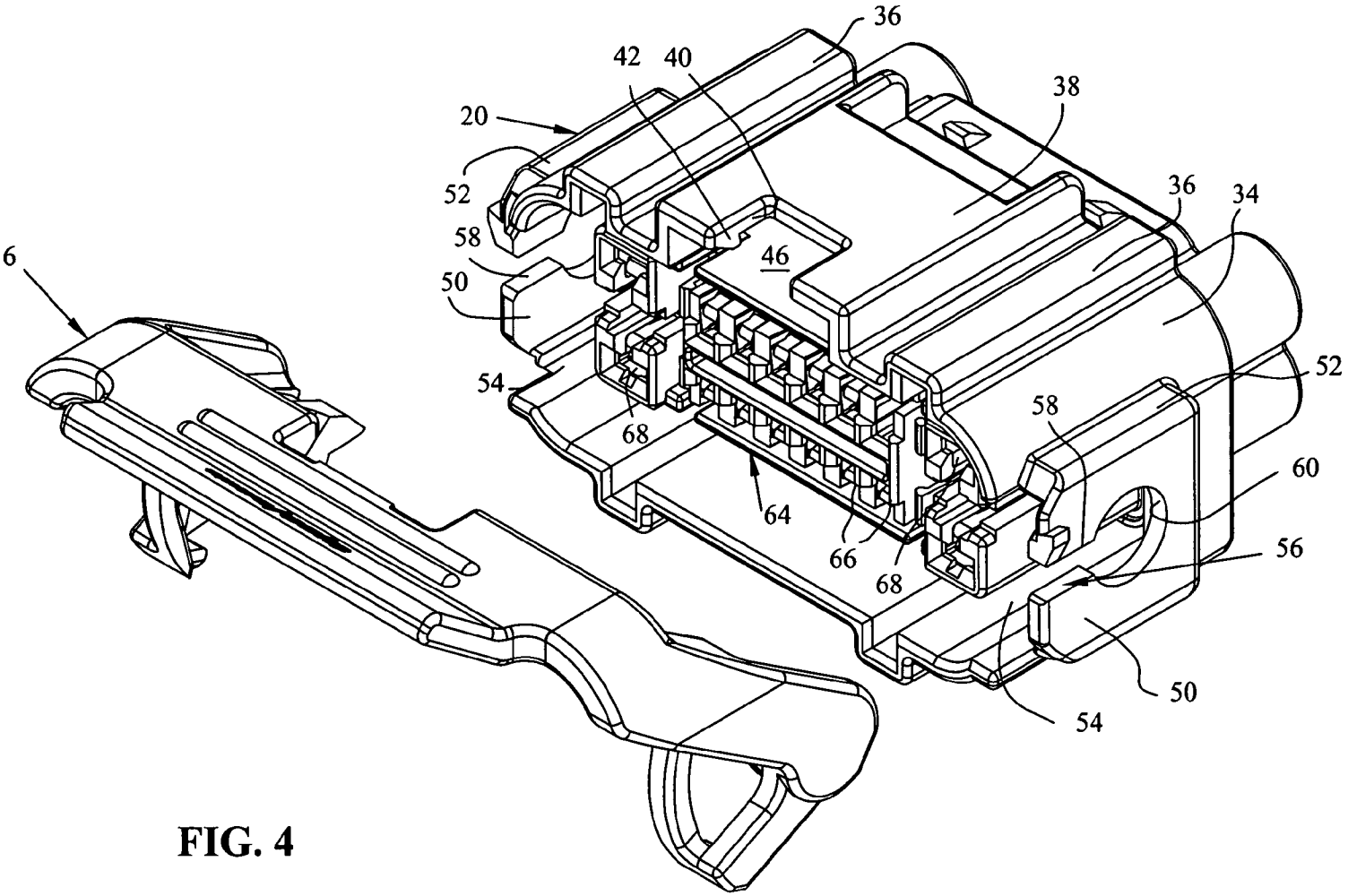
FIG. 4 shows an exploded view of the lever-assist plug housing in greater detail.

With reference now to FIG. 4, connector housing 20 and mating assist member 6 are shown exploded from each other, and connector housing 20 is shown in greater detail. Housing 20 generally includes an exterior profile defined by an outer shroud 34, which includes alignment channels 36, and further includes a central raised wall at 38. This central raised wall 38 includes a central notch at 40, with a latching mechanism in the form of locking projections 42 (only one of which can be viewed in FIG. 4) extending downwardly from the central raised wall 38 along the perimeter of notch 40, as will be further described herein. Raised wall 38 is spaced above an inner wall 46, and defines an opening therebetween for receipt of a mating latch as will also be described in greater detail herein.

With respect still to FIG. 4, connector housing 20 further includes a pair of mounting walls 50 connected to the connector housing 20 by side walls 52, separating mounting walls 50 from an inner portion of housing 20 and defining channels 54 therein. Mounting walls 50 further include mounting slots shown generally at 56, each including a narrowed passageway 58 opening into an enlarged circular bearing 60.

The connector housing 20 also includes a conventional internal housing portion at 64 having a plurality of terminal cavities, such as 66, for smaller electrical terminals and enlarged cavities at 68, for larger current carrying capacity electrical terminals.

Figure 5:
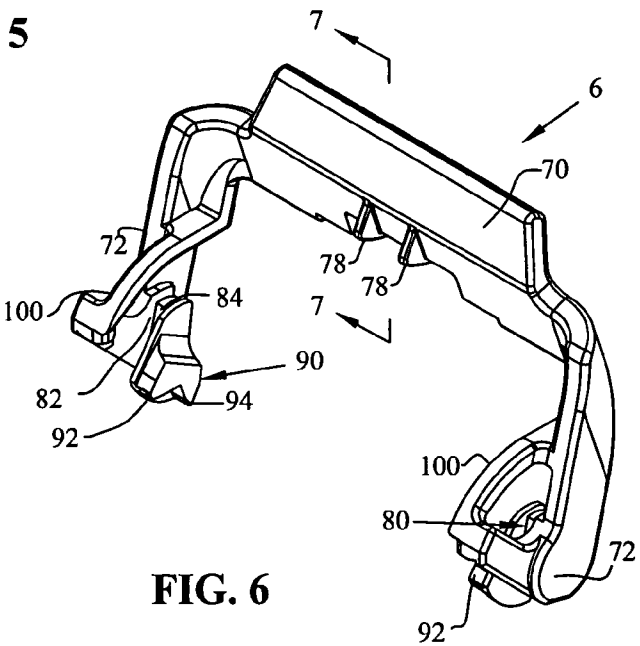
FIGS. 5 and 6 show alternative perspective views of the mating assist lever shown in FIG. 4.
Figure 6:
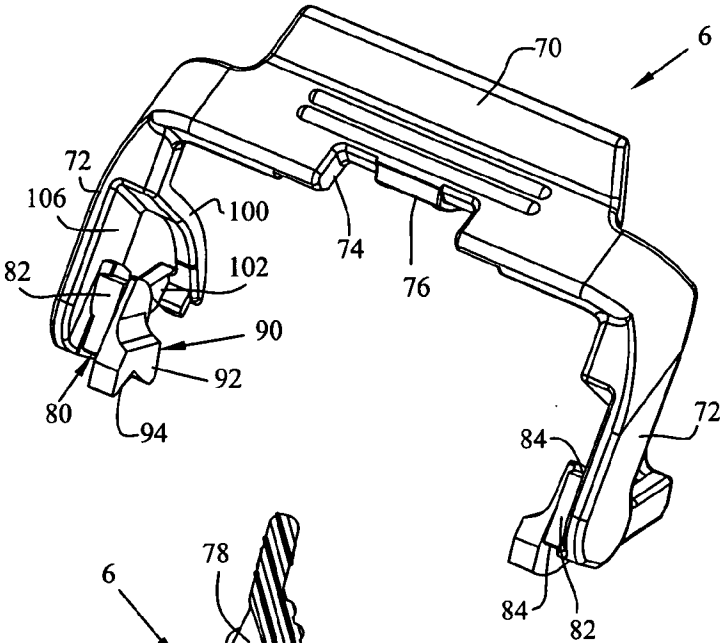
Figure 7:
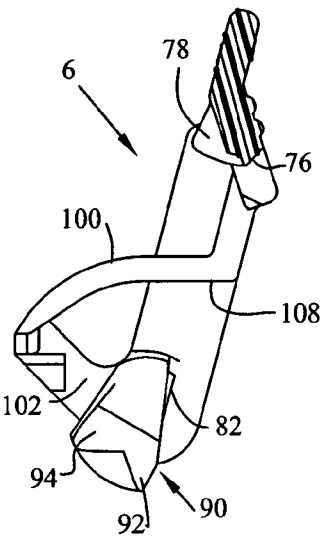
FIG. 7 shows a cross-sectional view through FIGS. 7-7 of FIG. 6.

With respect now to FIGS. 5 through 7, mating assist member 6 is comprised of an upper arm at 70 having side arms at 72. Upper arm 70 includes a notched portion at 74, which includes a first latching projection at 76, positioned at a trailing edge of the upper arm 70. As best shown in FIGS. 5 and 7, mating assist member 6 further includes at least one contoured surface to assist in releasing the latch assembly 10, shown here as two release projections 78 in FIGS. 6 and 7. With respect to FIGS. 5 and 6, mating assist member 6 further includes an axle portion at 80 including parallel and opposed flat surfaces 82, with upper and lower circular portions at 84.

With respect now to FIGS. 5 and 7, the mating assist member 6 further includes a pinion portion 90 having drive teeth 92 and 94. As shown in FIGS. 5 through 7, mating assist member 6 further includes an arcuate arm portion 100 connected to the side walls 72 via an arm portion 102, as best shown in FIG. 7. Arcuate arm portion 100 is spaced away somewhat from side walls 72 and positioned above axle portion 80 so as to cause an entry opening at 106, as best seen in FIG. 5. Arcuate arm portion 100 includes an inner contact surface at 108, as will be described in further detail.

Figure 8:
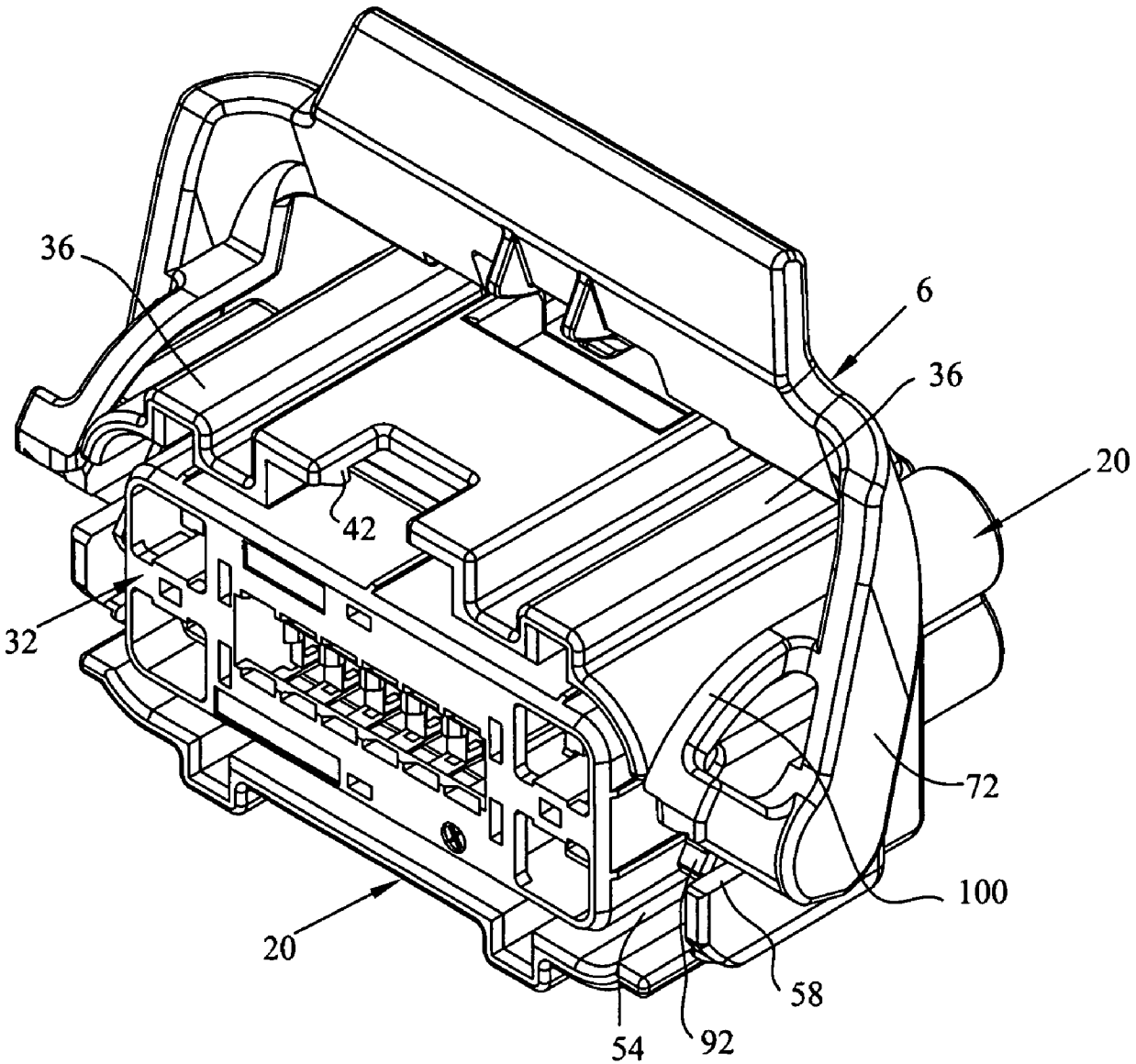
FIG. 8 shows the assembled view of the components of FIG. 4.

It should be appreciated that the axle portions 80 are profiled such that the flat surfaces 82 can be positioned between the narrowed passageways 58 (FIG. 4) with the circular portions 84 being rotatable within the enlarged circular bearing 60 (FIG. 4). With respect now to FIG. 8, connector housing 20 is shown with mating assist member 6 installed and rotated to an open position, whereby pinion tooth 92 is positioned within the channel 54 in an assist position and poised for interconnection with a mating connector, as will be described in greater detail herein.

Figure 9:
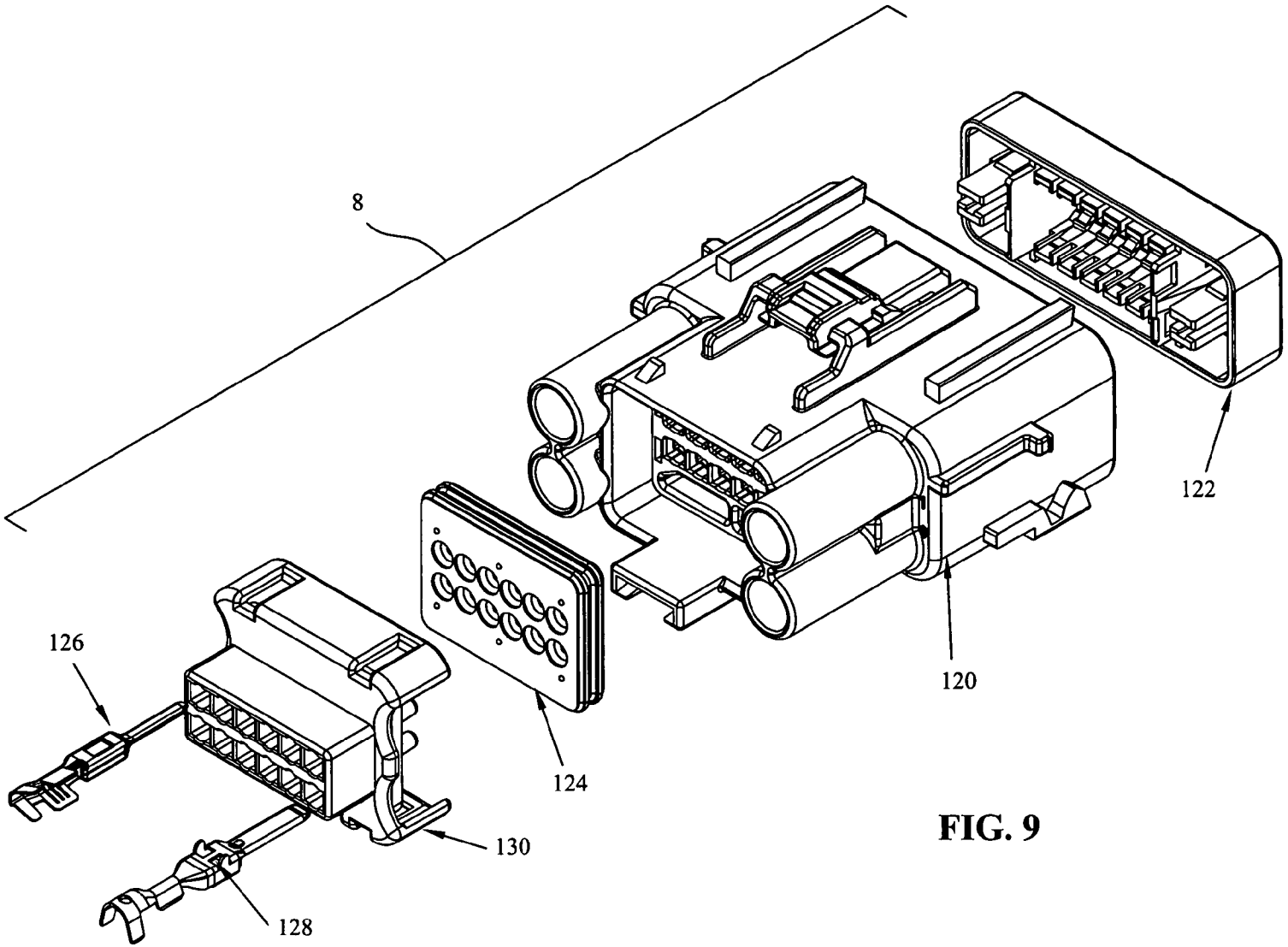
FIG. 9 shows an exploded view of the header or male connector, also shown in FIG. 1.
Figure 10:
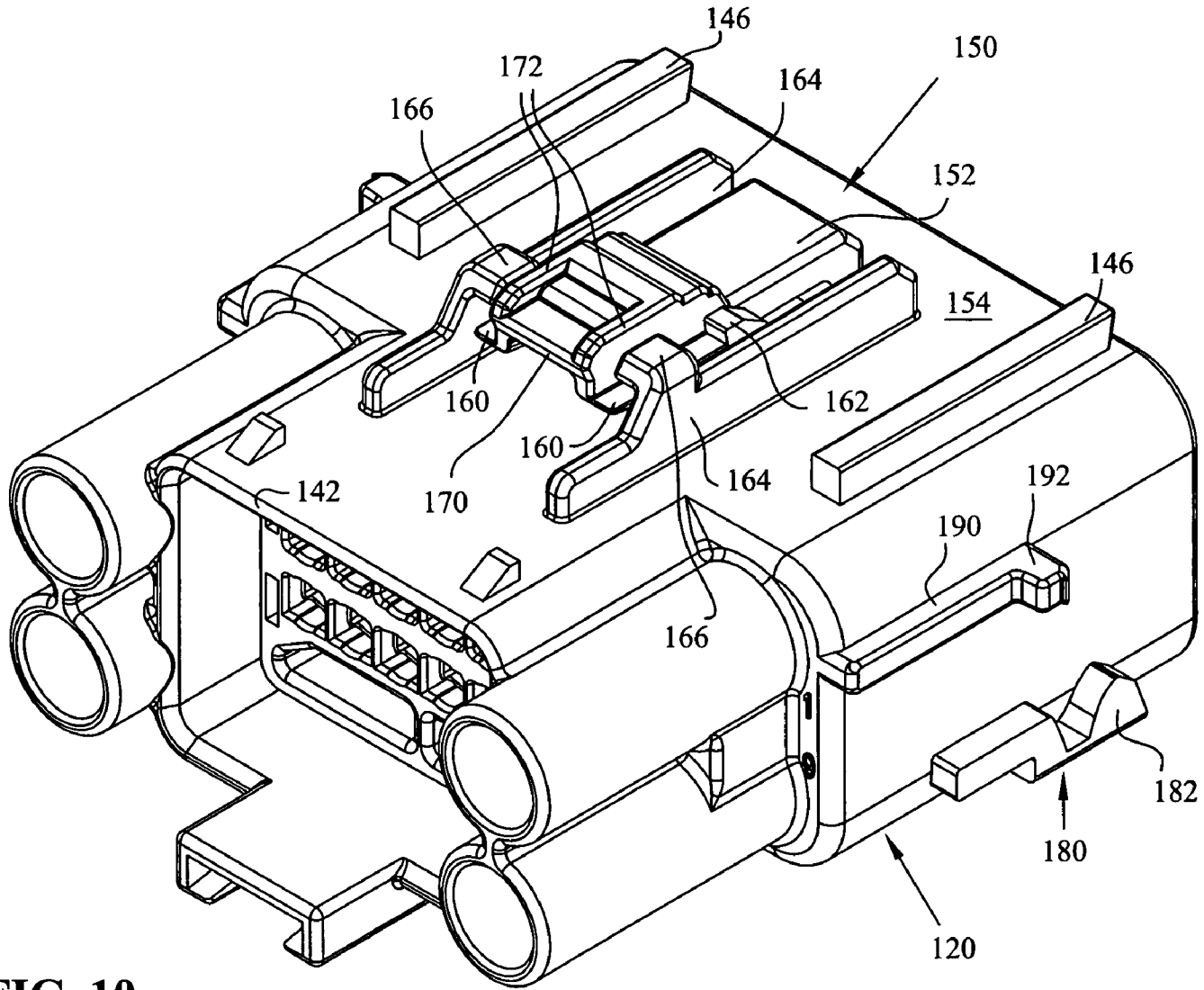
FIG. 10 shows an enlarged view of the housing portion of FIG. 9.
Figure 11:
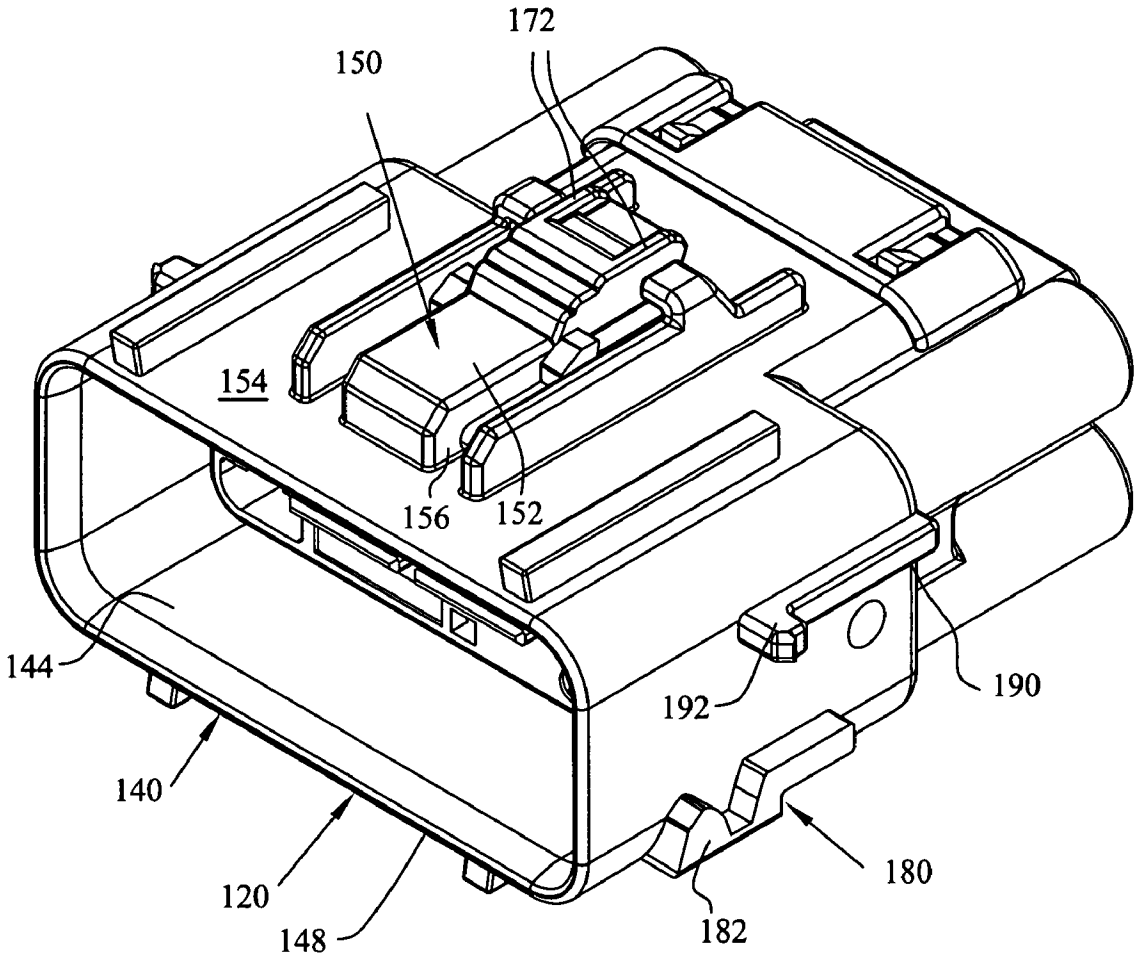
FIG. 11 shows the header assembly or male half of the connector from the opposite perspective as FIG. 10 shows the housing only.

With respect now to FIG. 9, header connector assembly 8 is shown in an exploded manner as including a housing portion 120, a terminal position assurance member (TPA) 122, a discrete wire seal 124, contacts or terminals 126 and 128, and rear cap 130. As shown in FIGS. 10 and 11, housing 120 includes a front end 140, and a rear wire-receiving end 142. Front end 140 includes a shrouded portion at 144, which is profiled to mate with the plug connector housing 20 with alignment ribs 146 positionable with alignment channels 36 (FIG. 4).

Housing 120 further includes a latch member 150, as a component of latch assembly 10 which includes a cantilever beam portion 152 integrally connected to a top wall 154 by a web portion 156, and extends rearwardly of the housing 120. As shown best in FIG. 10, cantilever beam portion 152 includes side wall sections 160 having locking projections 162 upstanding therefrom. Two side wall sections 164 flank the cantilever beam portion 152 and include overstress members 166. As shown in FIG. 10, the extreme end of cantilever beam portion 152 includes an angled edge portion 170, which defines a contacting surface, whereas the top of the latch cantilever beam portion 152 includes two contact surfaces at 172.

Finally, as shown in either of FIG. 10 or 11, housing 120 includes a portion 180 which provides an engagement lug, in the form of a simulated a gear rack including a first tooth 182, positioned on side wall 184. Housing 120 further includes alignment bars 190 having a locking extension at 192, again as will be described further herein.

Figure 12:
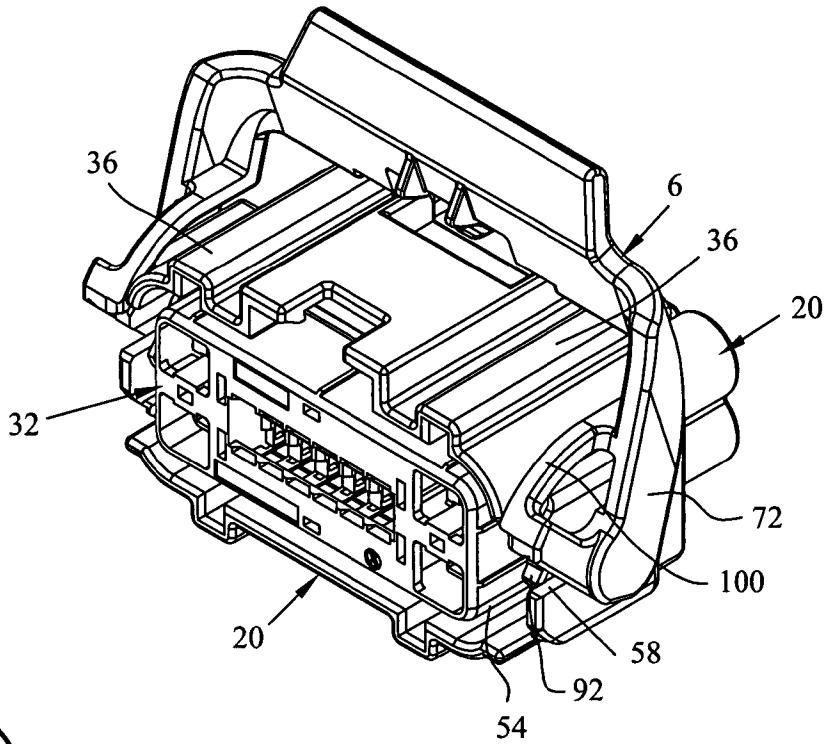
FIG. 12 shows a view showing the connectors of FIGS. 8 and 10 poised for interconnection.
Figure 12:
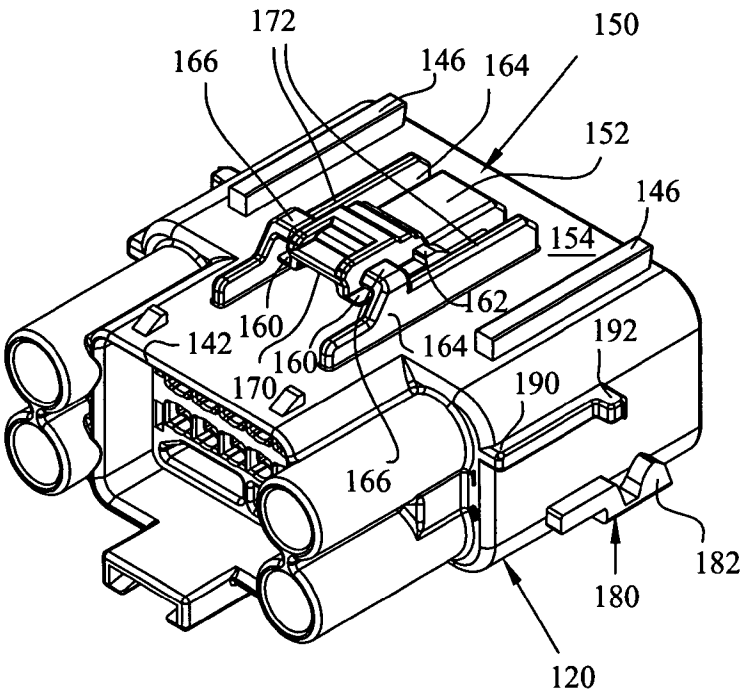

With both connector assemblies 4, 8 as described herein, the operation of the connector housings 20 and 120 will be described herein. As shown in FIG. 12, the two connector housings are mate able with the alignment ribs 146 aligning with the alignment channels 36, which positions locking extensions 192 in position in openings 106 (FIG. 6) of the mating assist member 6, and which positions rack tooth 182 in position to be received below pinion tooth 92. Thus, rotation of the mating assist member 6 in the counterclockwise sense (as viewed in FIG. 12) causes the engagement of the rack and pinion teeth 182, 92 causing the connectors to move into an interconnected state. At the same time, arcuate arm portions 100 rotate to entrap extensions 192.

Figure 13:
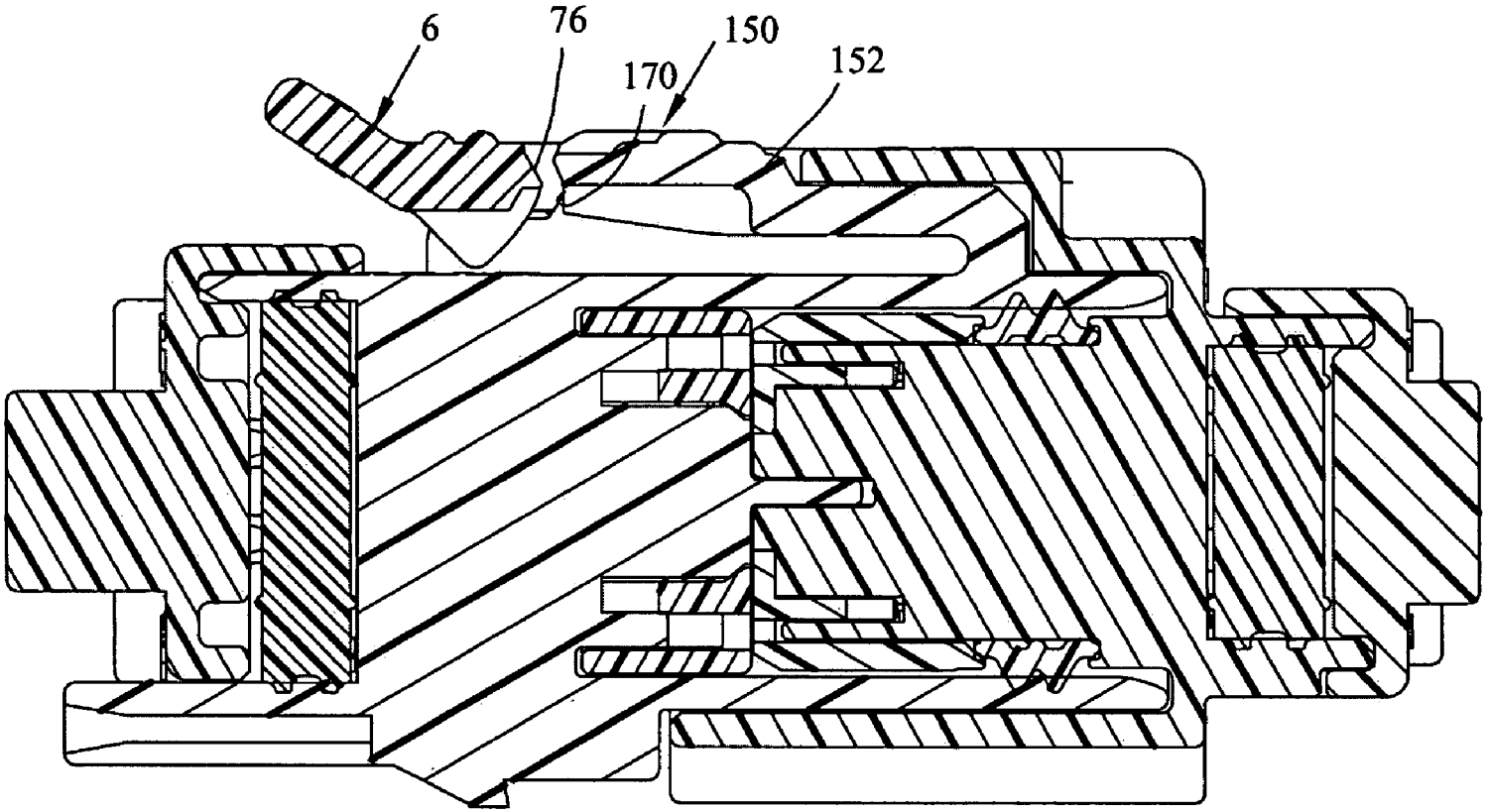
FIG. 13 shows a cross-sectional view through lines 13-13 of FIG. 1.

When the connectors are fully engaged, the connector pair is in the position of FIG. 1, and locking projections 162 are positioned behind locking projections 42. This also positions angled edge surface 170 in a close proximity to corresponding latching projection 76 on pivot-assist member as shown in FIG. 13. These two corresponding surfaces prevent disengagement between the two, as a counter-rotation of mating assist member 6 (that is in the clockwise position as viewed in FIG. 13) would cause the abutment of the latching projection 76 and edge surface 170 lifting latch member 150 into the overstress members 166 (FIG. 10).

Figure 14:
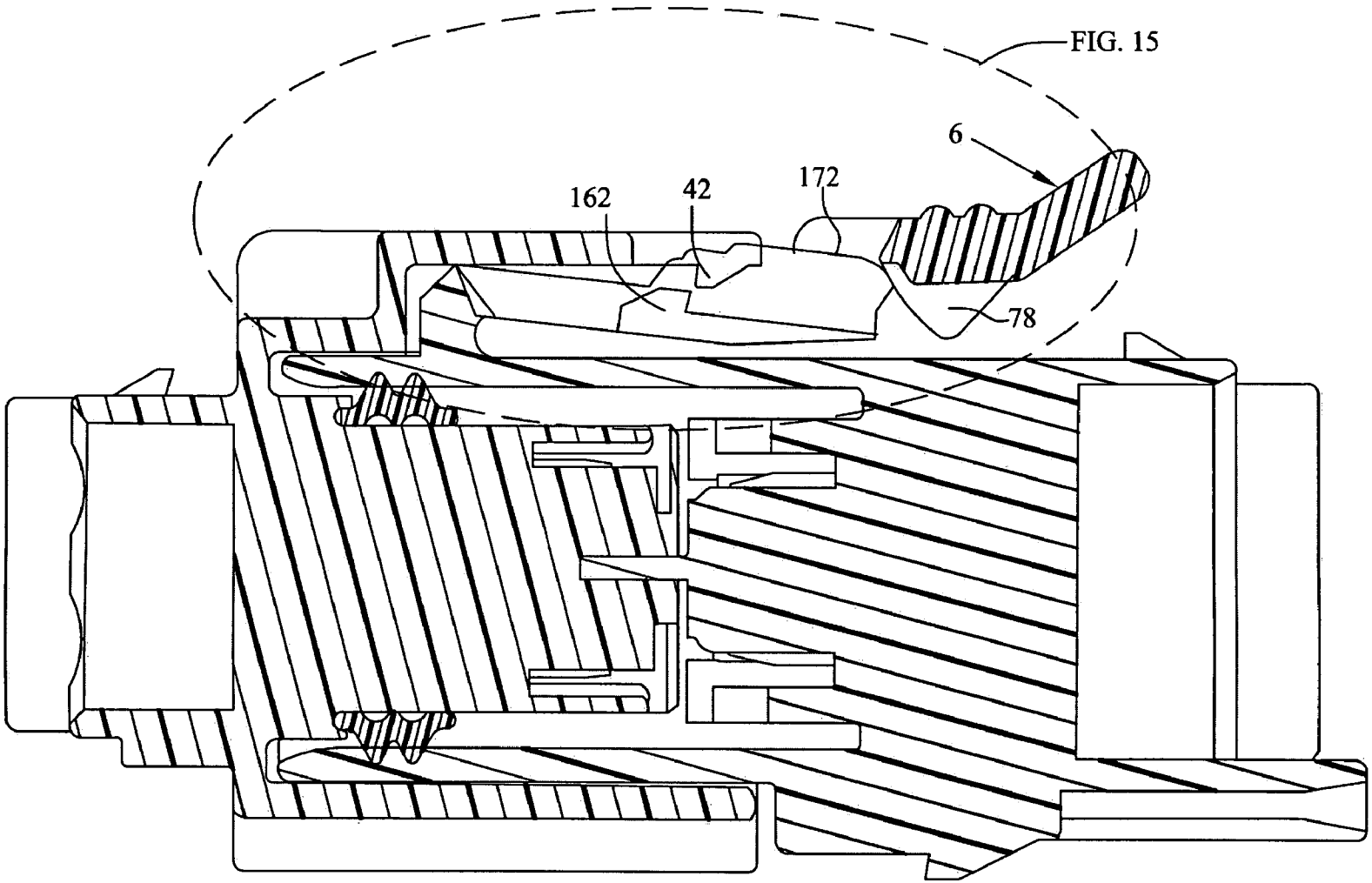
FIG. 14 shows the connectors of FIG. 13 in the initial disconnection state.
Figure 15:
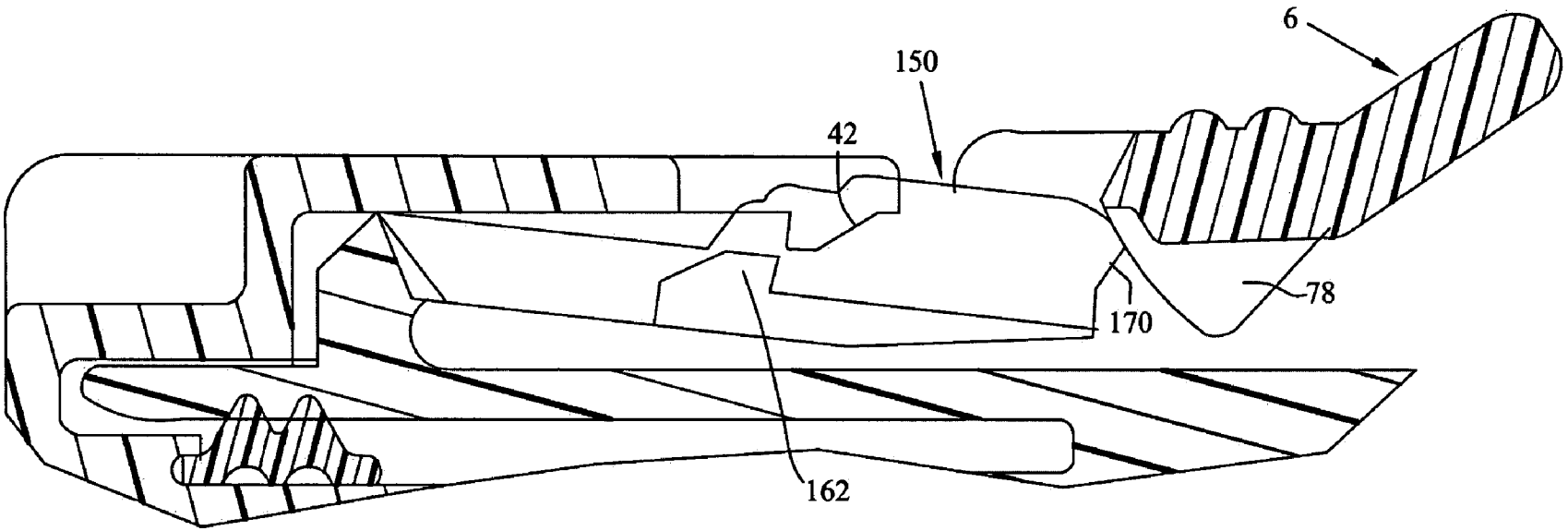
FIG. 15 is an enlarged view of the encircled portion on FIG. 14.
Figure 16:
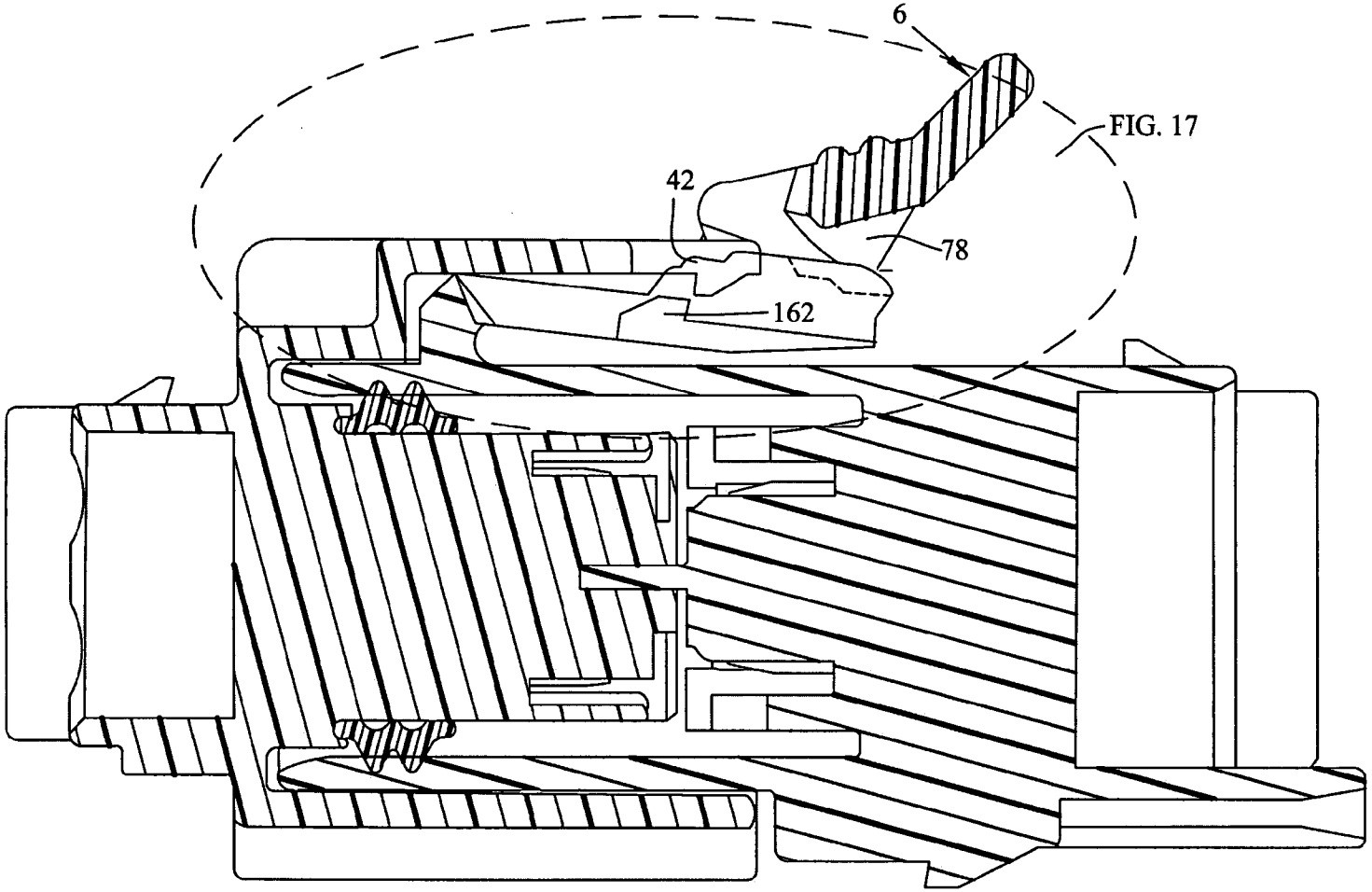
FIG. 16 is a cross-sectional view similar to that of FIG. 14 showing the connectors in a further disconnection state.
Figure 17:
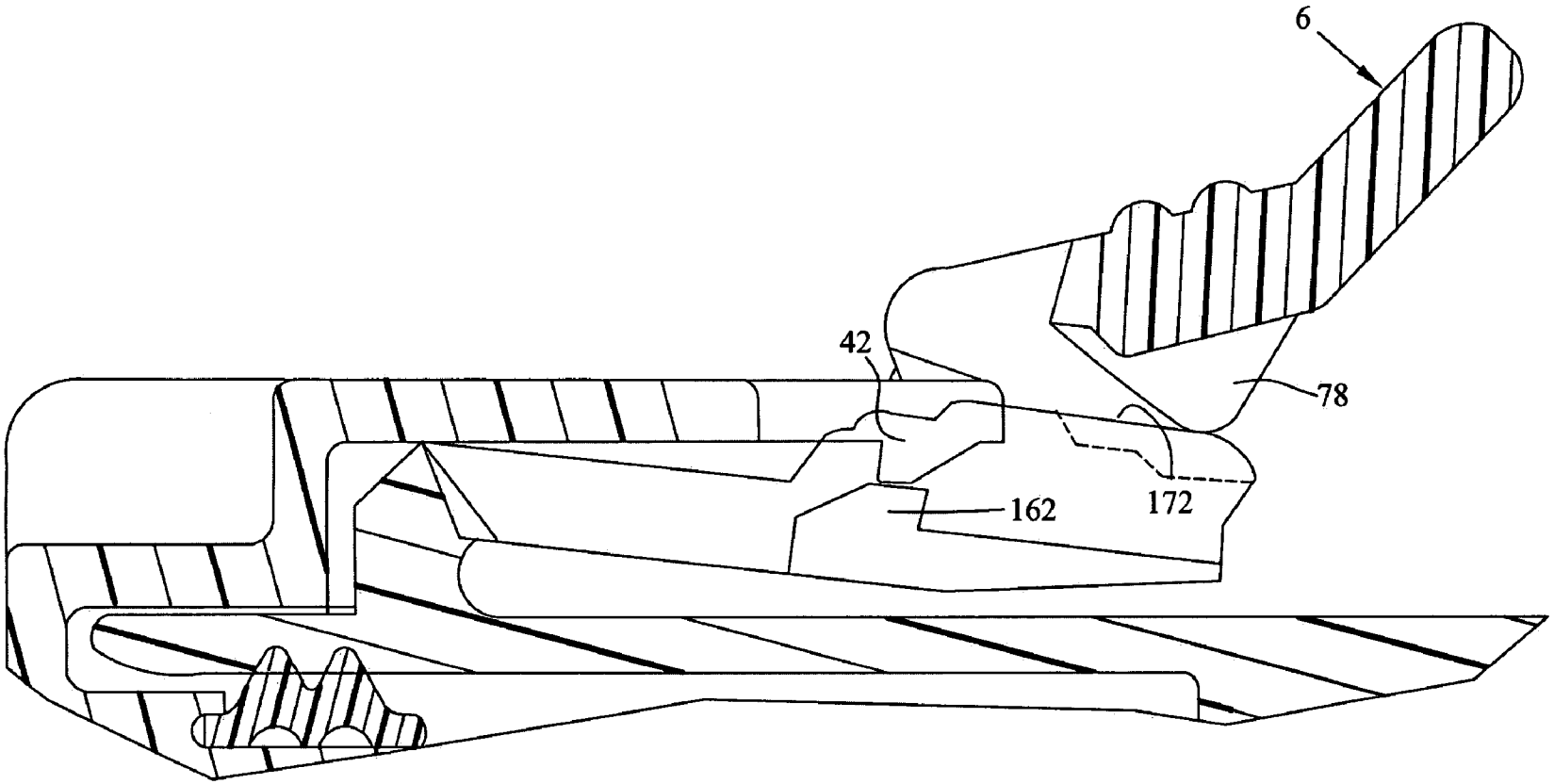
FIG. 17 shows an enlarged view of the encircled portion on FIG. 16.

At the same time, projections 78 assist in holding the latch member 150 down during the counter-rotation, allowing mating assist member 6 to be rotated without having to hold down latch member 150 by hand. With respect first to FIGS. 14 and 15, when the latch is initially depressed and the mating assist member 6 has begun a counter-rotation, in the counterclockwise sense as viewed in FIGS. 14 and 15, projections 78 have contoured surfaces which begin to ride up on surface 172, which holds the latch in the downward position such that locking projections 42 and 162 are clear of each other, as best shown in FIG. 15. Continued rotation of the mating assist member 6, to the position now shown in FIGS. 16 and 17, positions projection 78 further along on surface 172 and locking projection 162 has now cleared beneath locking projection 42, preventing snagging between the two connectors.

Advantageously, the mate assist member assists in the connection between the two connector assemblies 4 and 8, and locks them into the configuration of the cross-sectional view of FIG. 13. Also as mentioned above, projections 78 in the corresponding contact with contact surfaces 172 allow the mate assist member 6 to rotate and simultaneously hold the latch down such that the two connector housing assemblies can be disengaged. Said differently, projections 42, 162 are held in a disengaged state by the projections 78 until the two projections pass each other and clear, whereupon the two housing assemblies may be disconnected from each other. This prevents the user, from having to try to depress the latch assembly 10, while at the same time rotate the mate assist lever. Other advantages are shown in our patent application, Ser. No. 11/075,497, concurrently filed and incorporated herein by reference.

What is claimed is:

1. An electrical connector, for interconnection to a mate able connector, the mate able connector having a first latch to latch the electrical connector and the mate able connector together, the electrical connector comprising:

a connector housing comprising a second latch mating with the first latch and further comprising a mating assist member for assisting in the drawing together of said connector housing and the mate able connector, said mating assist member having a contoured surface which is profiled to engage a contact surface of the first latch upon movement of said mating assist member during counter rotation, thereby unlatching said first and second latches.

2. The electrical connector of claim 1, wherein the mating assist member is comprised of a lever.

3. The electrical connector of claim 2, wherein said lever is profiled as a pinion gear with gear teeth which mesh with teeth on the mate able connector.

4. The electrical connector of claim 1, wherein said mating assist member is locked to the latch, when in the fully latched position.

5. The electrical connector of claim 4, wherein said mating assist member is comprised of a lever which rotates into a snapped lock position with the latch, when in a fully latched position.

6. The electrical connector of claim 5, wherein said lever is comprised of an upper lever arm and two side arms, which pivot relative to said housing.

7. The electrical connector of claim 6, wherein a trailing edge of said upper lever arm is profiled to snap lock beneath the latch of the mate able electrical connector.

8. The electrical connector of claim 1, wherein said contoured surface is comprised of a projection, profiled to engage said latch upon movement of said mating assist member.

9. The electrical connector of claim 8, wherein said latch is profiled as a cantilevered beam extending rearwardly of said housing.

10. The electrical connector of claim 9, wherein an extreme end of said cantilevered beam is defined as a contacting surface.

11. The electrical connector of claim 10, wherein said mating assist member is comprised of a lever which rotates into a snapped lock position with said contacting surface, when in the fully latched position.

12. An electrical connector assembly, comprising a first connector housing for interconnection to a mate able second connector housing, one of said connector housings having a latch to latch said first connector housing and said mate able second connector together, the other of said connector housings having a mating assist member for assisting in the drawing together of said connector housings, said mating assist member having a contoured surface which, when in the fully mated position, is positioned adjacent to and opposing said latch, so as to cooperate with, and hold down the latch, during counter rotation of the mating assist member.

13. The electrical connector of claim 12, wherein said mating assist member is comprised of a lever.

14. The electrical connector of claim 13, wherein said lever is profiled as a pinion gear with gear teeth which mesh with teeth on the mate able connector.

15. The electrical connector of claim 14, wherein said mating assist member is locked to said latch, when in a fully latched position.

16. The electrical connector of claim 15, wherein said mating assist member is comprised of a lever which rotates into a snap locked position with said latch, when in the fully latched position.

17. The electrical connector of claim 16, wherein said lever is comprised of an upper lever arm and two side arms, which pivot relative to said housing.

18. The electrical connector of claim 17, wherein a trailing edge of said upper lever arm is profiled to snap lock beneath the latch of the mate able electrical connector.

19. The electrical connector of claim 12, wherein said contoured surface is comprised of a projection, profiled to engage said latch upon movement of said mating assist member.

20. The electrical connector of claim 19, wherein said latch is profiled as a cantilevered beam extending rearwardly of said one connector housing.

21. The electrical connector of claim 20, wherein an extreme end of said cantilevered beam is defined as a contacting surface.

22. The electrical connector of claim 21, wherein said mating assist member is comprised of a lever member which rotates into a snapped lock position with said contacting surface, when in the fully latched position.

23. An electrical connector assembly, comprising a first connector housing for interconnection to a mate able second connector housing, one of said connector housings having a latch to latch said first connector housing and said mate able second connector together, the other of said connector housings having a mating assist member for assisting in the drawing together of said connector housings, said mating assist being locked to said latch, when in a fully latched position, and being profiled to disengage said latch when counter rotated.

24. The electrical connector of claim 23, wherein said latch is profiled as a cantilevered beam extending rearwardly of said one connector housing.

25. The electrical connector of claim 24, wherein an extreme end of said cantilevered beam is a contacting surface.

26. The electrical connector of claim 25, wherein said mating assist member is comprised of a lever which rotates into a snapped lock position with said contacting surface, when in the fully latched position.

27. The electrical connector of claim 26, wherein said lever is comprised of an upper lever arm and two side arms, which pivot relative to said housing.

28. The electrical connector of claim 27, wherein a trailing edge of said upper lever arm is profiled to snap lock beneath the latch of the mate able electrical connector.

29. The electrical connector of claim 23, wherein said mating assist member has a contoured surface to cooperate with, and hold down the latch, during the counter rotation of the mating assist member.

30. The electrical connector of claim 29, wherein said contoured surface is comprised of a projection, profiled to engage said latch upon movement of said mating assist member.

* * * * *